United States Patent [19]

Hirai et al.

[11] Patent Number: 4,566,825

[45] Date of Patent: Jan. 28, 1986

[54] METHOD OF HARDENING SOFT GROUND

[75] Inventors: Yoshihisa Hirai, Kokubunji; Masanori Shima, Murayama; Hirohiko Aoki, Tokyo, all of Japan

[73] Assignee: Toa Harbor Works Co., Ltd., Tokyo, Japan

[21] Appl. No.: 695,032

[22] Filed: Jan. 25, 1985

[30] Foreign Application Priority Data

Mar. 21, 1984 [JP] Japan ..... 59-52271

[51] Int. Cl.[4] ..... E02D 3/12; E02D 5/18; E01C 7/36

[52] U.S. Cl. ..... 405/267; 404/76; 405/269

[58] Field of Search ..... 404/75, 76, 92; 405/229, 233, 236, 240, 241, 248, 256, 266, 267, 269, 270, 271

[56] References Cited

U.S. PATENT DOCUMENTS

| | | | |
|---|---|---|---|
| 4,065,928 | 1/1978 | Takagi et al. | 405/267 |
| 4,084,383 | 4/1978 | Kukino et al. | 405/269 |
| 4,089,183 | 5/1978 | Endo et al. | 405/267 |

FOREIGN PATENT DOCUMENTS

| | | | |
|---|---|---|---|
| 159417 | 12/1981 | Japan | 405/266 |
| 89016 | 6/1982 | Japan | 405/266 |
| 172026 | 10/1982 | Japan | 405/267 |
| 4018 | 1/1983 | Japan | 405/266 |
| 903826 | 8/1962 | United Kingdom | 405/266 |

*Primary Examiner*—Stephen J. Novosad
*Assistant Examiner*—John F. Letchford
*Attorney, Agent, or Firm*—Armstrong, Nikaido, Marmelstein & Kubovcik

[57] ABSTRACT

The present invention provides a method of improving soft ground.

In this method, slurry formed by a mixture of cement-based hardener and water is supplied to the soft ground under pressure and is mixed with soft soil thereby to harden the same. Then, at least when a ground improvement machine having mixing propellers is penetrated into the above-mentioned soft soil, the cement-based hardening slurry is discharged from the mixing propellers.

Further, in another method of improving soft ground according to the present invention, slurry formed by a mixture of cement-based hardener and water is supplied to the soft ground under pressure and is mixed with soft soil. Then, when deep and short walls, both consisting of mixed layer of the cement-based hardening slurry and the soft soil are formed one after the other, a plurality of deep walls are formed at a distance therebetween and then the short walls are jointly formed between a plurality of these deep walls.

6 Claims, 12 Drawing Figures

METHOD OF HARDENING SOFT GROUND

BACKGROUND OF THE INVENTION

The present invention relates to a method of hardening soft ground and, more particularly, a method of hardening soft soil such as clay, silt or the like by mixing it with a cement-based hardener.

It is widely known that Japanese islands consist of soft ground most predominantly among the world. Recently, as urban development proceeds in Japan, a lack of land has come to present a serious problem since habitable land areas are extremely limited in Japan. For this reason, unused soft ground is improved or hardened so that structures may be constructed thereon.

As a matter of fact, a wide variety of methods have heretofore been proposed to improve such ground.

However, to cope with a general demand for shortening the total construction period and increasing the size and weight of structures, the period to be involved in the hardening performance is required to be shortened and the strength of soft ground is also required to be more securely improved. Moreover, it is strongly desired that environmental destruction and pollution through such performance be prevented.

In view of the foregoing, there has recently been developed a method of improving soft ground with the aid of a cement-based hardener, namely, such a method of hardening the soft ground by mixing a cement-based hardener with soft soil.

In this method, mixing propellers of a ground improvement machine are penetrated into soft ground so as to mix a cement-based hardener with soft soil.

In such method of hardening soft ground, the following measures have heretofore been taken according to performance and soft soil conditions:

(1) improved soil piles wherein the soft soil and a cement-based hardener are mixed by the ground improvement machine are successively cemented together to thereby harden the overall soft ground; and (2) deep walls which reach the bearing stratum and short walls which do not reach it are jointly formed one after the other to thereby harden the soft ground.

In the measure (1), upon the extraction of the ground improvement machine from the soft ground, slurry consisting of a mixture of the cement-based hardener and water is supplied from a position located above the mixing propellers while the soft soil and the hardener are mixed upon rotation of the mixing propellers so as to form mixed layer of the soft soil and the cement-based hardener. The soft soil is thus hardened on account of the hardening effect of the cement.

More concretely, as shown in FIG. 1, a ground improvement machine 1 is provided with mixing propellers 3 mounted to the lower part of shafts 2, said machine 1 being moved upward and downward by means of a driving means 4 whereby said mixing propellers are rotated.

To begin with, for example, the machine 1 is penetrated into a soft ground 5 until it reaches bearing stratum G. The machine 1 is extracted in the direction of an arrow A whereby the mixing propellers 3 are rotated therewith. At the same time, a cement-based hardener in a slurry state is supplied from a position located above uppermost mixing propellers 3A, for example, a position adjacent to the front end of an arrow B while the soft soil and the hardener are mixed. Furthermore, while the machine is extracted, improved soil pile consisting of mixed layer 6 of the soft soil and the hardener is formed. Then, another improved soil pile is jointly formed with this soil pile in the same manner as above and, thereafter, the same process is repeatedly carried out in order to harden the overall soft ground.

In such measure, however, as shown in FIG. 2, an outlet 7 for supplying the cement-based hardening slurry is fixedly provided above the mixing propellers 3, so that the hardener is supplied to only one fixed point in the soft ground. Thus, the mixture of the hardening slurry and soft soil is dependent only upon mechanical mixing of the mixing propellers 3.

Thus, the distance the hardening slurry is to be moved from the outlet 7 by the propellers 3 is relatively great. For this reason, the hardening slurry and soft soil are not readily evenly mixed and therefore, a considerable amount of time is necessary for the even mixture thereof.

Further, as stated above, since the location at which the hardening slurry is supplied is fixed, the area where the hardening slurry and soft soil may be mixed is limited even if the diameter of the mixing propellers 3 is increased under existing performing conditions, although it may be dependent upon the penetrating or extracting velocity of the machine 1 and the rotational number of the mixing propellers 3.

It should be mentioned that normally, the mixing propellers 3 are approximately one meter (1 m) in diameter at the most. There exists a problem, therefore, that the machine must repeatedly be shifted a number of times so as to improve a wide range of ground.

Another problem to be faced when the new improved soil pile is cemented to existing improved soil pile is such that some unimproved ground may remain therebetween unless the route taken upon the penetration of the machine and that taken upon the extraction thereof are completely identical or the machine is positioned closer to existing hardened ground side. As a matter of fact, as shown in FIG. 1, upon the extraction of the machine 1 the front end of the machine 1 tends to move outside, namely in the direction of an arrow C where mixing resistance is relatively small. Consequently, unimproved ground 9 remains between existing hardened ground 8 and mixed layer 6 newly formed by the hardening slurry and soft soil and therefore, hardened ground may not successively be formed.

In order to closely joint the existing improved ground 8 with the newly formed mixed layer 6, as shown in FIG. 3, the front end of the machine 1 must be pressed onto the existing improved ground 8 upon the extraction of the machine 1 thereby to cut the existing improved ground 8.

Further, in the event that the hardening process of the existing improved ground 8 has already commenced, such cutting is difficult to be carried out.

Especially, in the event that the hardening performance is discontinued due to bad weather or mechanical trouble, the soft soil mixed with the cement-based hardener becomes completely hardened. Hence, it may be impossible to joint the existing improved ground with a newly formed layer.

On the other hand, the measure (2) is such that as shown in FIG. 4, deep walls 11 and short walls 10 are formed one after the other thereby to harden the overall soft ground. As shown in FIG. 5, for example, when the deep walls 11 are jointly formed with the short walls 10, the deep walls 11 are supported on the bearing stratum G whereas the short walls 10 are not supported thereon although they are in abutment with the soft ground 5. Furthermore, as the ground improvement machine cuts the short walls when it is penetrated or extracted so as to facilitate the better cementing between the deep walls 11 and short walls 10, the short walls are lowered or raised by the mixing propellers upon the penetration or extraction of the ground improvement machine.

Especially, in a conventional method as mentioned above, the cement-based hardening slurry is supplied upon the extraction of the ground improvement machine. Accordingly, as shown in FIG. 6, unless the route taken upon the penetration of the machine (unbroken line) and that taken upon the extraction thereof (broken line) is identical, unhardened soil X may be left. There is a problem, therefore, that the deep walls 11 and short walls 10 may not sufficiently be cemented together.

In order to overcome this problem by a conventional method, the route taken upon the penetration of the machine and that taken upon the extraction thereof are required to be identical. However, it should be mentioned that this is not actually possible.

SUMMARY OF THE INVENTION

It is a primary object of the present invention to provide a method of hardening soft ground which hardens and stabilizes soft ground by swiftly and properly mixing a cement-based hardener with soft soil.

Another object of the present invention is to provide a method of hardening soft ground which enables jointly forming deep walls with short walls without rendering an undesirable effect thereto.

A further object of the present invention is to provide a method of hardening soft ground which enables to increase the area of soft ground to be hardened by one single mechanical operation of penetration and extraction and thereby shorten the period of time required for the hardening performance.

A still further object of the present invention is to provide a method of hardening soft ground, wherein the amount of soil to be cut by a ground improvement machine is less as compared to a conventional method.

An even further object of the present invention is to provide a method of hardening soft ground, wherein newly improved ground is well cemented to existing improved ground.

In a method of hardening soft ground wherein slurry formed by a mixture of a cement-based hardener and water is supplied to the soft ground under pressure to thereby harden the soft ground by mixing the same with soft soil, such objects of the present invention are achieved by discharging the cement-based hardening slurry from mixing propellers at least when the ground improvement machine having mixing propellers is penetrated into the soft ground.

Further, in a method of hardening soft ground wherein the slurry formed by a mixture of a cement-based hardener and water is supplied to the soft ground under pressure so as to mix the same with the soft soil and deep walls and short walls each consisting of a mixed layer of the cement-based hardening slurry and the soft soil are formed one after the other, the objects of the present invention are achieved by forming a plurality of deep walls at least at a distance therebetween and then jointing forming the short walls between a plurality of these deep walls.

Still further, in a method of hardening soft ground wherein the slurry formed by a mixture of a cement-based hardener and water is supplied to the soft ground under pressure so as to mix the same with the soft soil and deep walls and soft walls each consisting of a mixed layer of the cement-based hardening slurry and the soft soil are formed one after the other, the objects of the present invention are achieved by discharging the cement-based hardening slurry from the mixing propellers of the ground improvement machine upon the penetration thereof when a plurality of deep walls are formed at least at a distance therebetween and then short walls are jointly formed between a plurality of deep walls.

THE PREFERRED EMBODIMENT OF THE INVENTION

Figure 7:
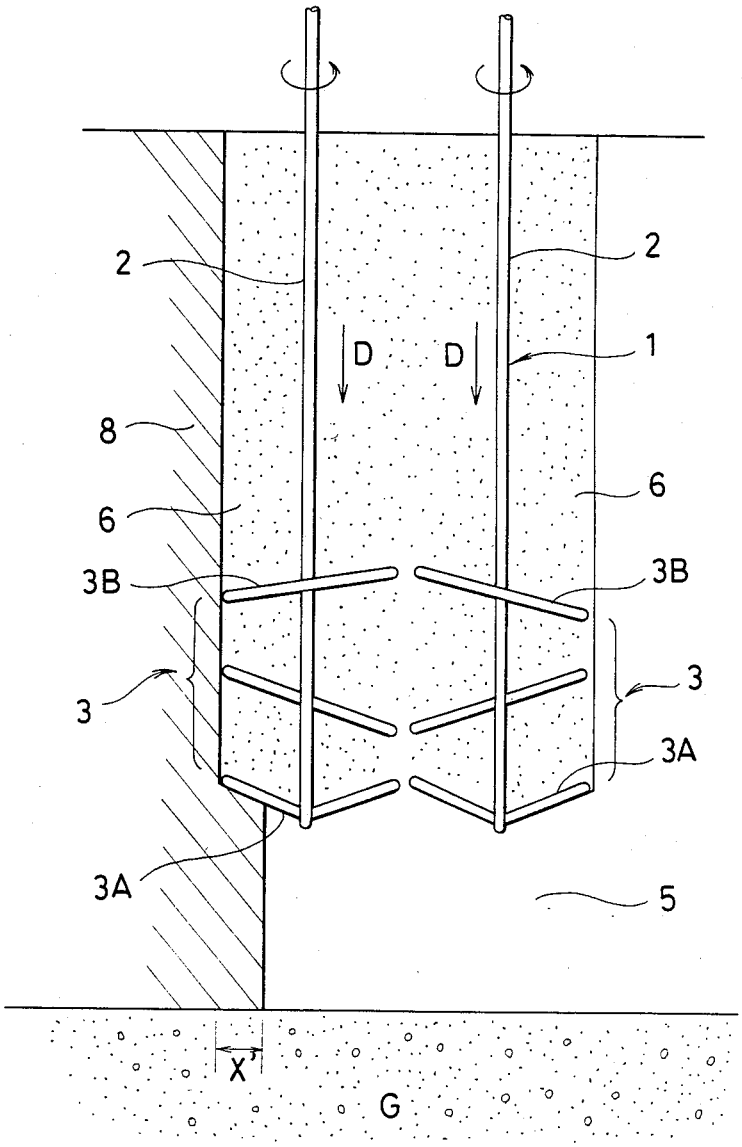
FIG. 7 is a schematic representation explaining a method according to the present invention.

According to the present invention, as shown in FIG. 7, a ground improvement machine 1 having mixing propellers 3 is penetrated into soft ground 5. At least upon this penetration, a cement-based hardening slurry is discharged from the mixing propellers to thereby mix the slurry with the soft soil. In this manner, deep walls reaching the bearing stratum G are formed.

A cement-based hardener may be discharged from any of a plurality of mixing propellers provided one above the other at the front ends of shafts of the ground improvement machine. It is preferable, however, that the cement-based hardener is discharged from the lowermost mixing propellers 3A so as to properly mix the hardener with the soft soil.

After the ground improvement machine reaches the bearing stratum G, the machine is extracted through the soil pile formed upon the penetration thereof. When the machine is extracted, normally, the cement-based hardeners is not discharged and instead, only mixing is carried out.

However, in mixing the cement-based hardening slurry with the soft soil, the rotational number of the mixing propellers of the ground improvement machine is limited and the discharge amount of the cement-based hardening slurry mixable with the soft soil is also limited. Accordingly, when the soft soil and cement-based hardening slurry are necessarily to be further properly mixed and a large amount of the hardening slurry is necessary to be discharged, the hardening slurry may be discharged from the mixing propellers also upon the extraction of the ground improvement machine.

Thus, when the cement-based hardener is discharged also upon the extraction of the ground improvement machine, it may preferably be discharged from the uppermost mixing propellers 3B.

Briefly, according to the present invention, the cement-based hardening slurry is discharged from the mixing propellers at least when the ground improvement machine is penetrated into the soft ground.

As explained in FIG. 7, the improved soil pile reaches the bearing stratum G. However, the present invention is not limited to this embodiment. Further, the improved soil pile is not required to reach the bearing stratum G depending upon the hardness of the ground or the weight of a structure constructed on this hardened ground.

The cement-based hardener to be used in the present invention is of normal Portland cement or Portland blast-furnace cement. Such hardener may be used in a slurry state.

According to the present invention, in order to delay the hardening process of such cement-based hardener, slow-hardening cement-based hardener may preferably be employed.

As for the slow-hardening cement-based hardener, for example, as set forth in Japanese patent application laying-open publication No. 58-98382, it may consist of hydraulic slug 50 to 90 percent by weight, Portland cement 8 to 30 percent by weight, and insoluble II-Type anhydrous gypsum or gypsum 2 to 20 percent by weight.

It should be mentioned that the hydraulic slug is, for example, such that furnace rapid cooling slug used in the iron industry is finely ground. The amount of the slug to be used is preferably 60 to 70 percent by weight. When the addition of this slug is less than 50 percent by weight, hardening time may be shortened. On the other hand, when it is greater than 90 percent by weight, predetermined strength of improved ground may not be obtained.

Further, the amount of the Portland cement is preferably 20 to 25 percent by weight. When it is greater than 30 percent by weight, the hardening time may be shortened. On the other hand, when it is less than 8 percent by weight, the predetermined strength of the improved ground may not be obtained.

The amount of the insoluble II-type anhydrous gypsum or gypsum is preferably 10 to 15 percent by weight. When it is greater than 20 percent by weight, the hardening time may be prolonged whereas the predetermined strength may not be obtained. On the other hand, when it is less than 2 percent by weight, necessary strength may not be obtained.

The addition of the slow-hardening cement-based hardener to the soft soil varies according to the quality thereof. However, it is normally 5 to 20 percent by weight in relation to wet unit weight of the soft soil.

By the use of such slow-hardening cement-based hardener, the hardening process of the cement may be delayed four (4) to seven (7) days in its initial stage. Accordingly, as mixing resistance is not increased due to the hardening of the cement slurry, hardening performance may readily be carried out and thus the cement slurry and soft soil may securely be mixed. Additionally, as the hardening process of the cement is delayed, the existing improved ground and the new improved ground may mutually and properly be cemented together even after a long period of time has passed, to the extent that it is within the time of the hardening of the cement.

Figure 8A:
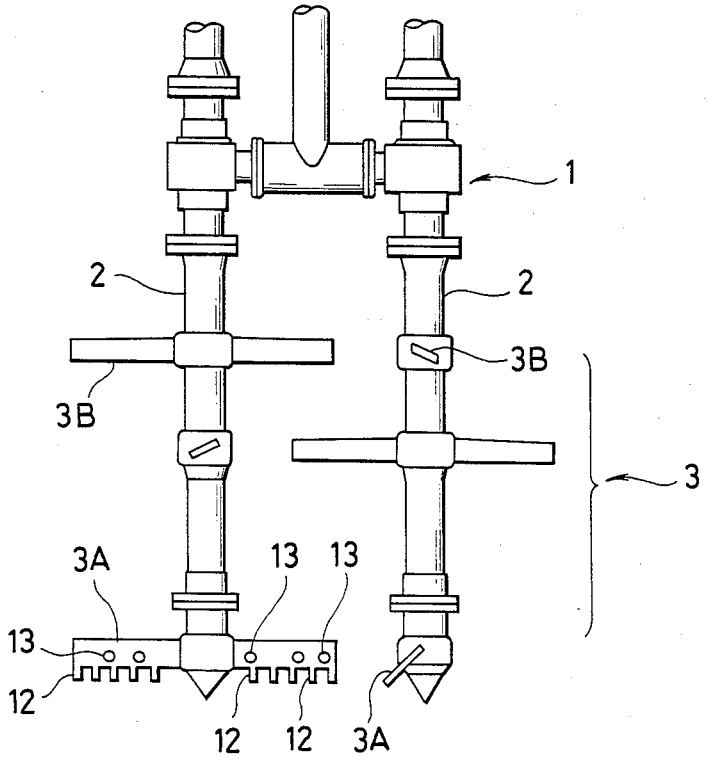
FIG. 8A is a side view of a ground improvement machine to be employed in a method according to the present invention.

An embodiment of the ground improvement machine to be employed in a method according to the present invention will be described with reference to FIG. 8A.

Namely, the ground improvement machine 1 comprises two vertical shafts 2, 2 and a plurality of mixing propellers 3 provided at the lower end of said shafts 2, 2, said machine 1 being rotated by a driving means (not shown) so as to penetrate into the soft ground.

The lowermost mixing propellers 3A are provided with cutting nails 12 thereby to facilitate the penetration into the soft ground.

Any number of discharge openings 13 may be provided at the lowermost mixing propellers 3A so as to discharge the hardening slurry. While the machine 1 is rotated upon the penetration into the soft ground, the cement-based hardening slurry is discharged from the discharge openings 13 and supplied to the soft ground under pressure so as to mix the same with the soft soil.

Figure 8B:
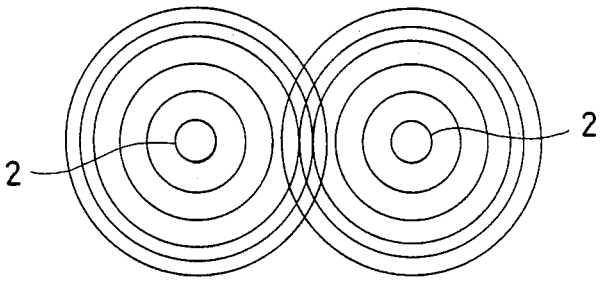
FIG. 8B shows the track of hardening slurry discharged.

Accordingly, as shown in FIG. 8B, the hardening slurry discharged from the discharge openings is concentrically provided respectively around the shafts 2 upon rotation of the mixing propellers 3A whereby the mixture of the hardening slurry and soft soil may be facilitated.

The number of the discharge openings 13 may optionally be determined according to the amount of the hardening slurry to be employed.

Provided that the diameter of the mixing propellers 3 and the number of the discharge openings 13 are increased, the volume of the soft soil to be treated by one single operation may also be increased.

Now, according to the present invention, in order to supply the hardening slurry in such a manner that the improved ground with the hardening slurry already injected is in abutment therewith, as shown in FIG. 7, while part of the improved ground 8 is cut by the mixing propellers 3, the hardening slurry is discharged upon the penetration of the ground improvement machine 1. After the soft soil of predetermined depth is improved, the machine is extracted.

According to the present invention, even if the route taken upon the penetration of the machine and that taken upon the extraction thereof are not completely identical, unimproved soil will not remain since the hardening slurry and soft soil have already been mixed when the machine is penetrated thereinto.

Accordingly, an overlapping part shown by X' may be created between existing improved ground and newly improved ground whereby they may properly be cemented together.

Further, in the present invention, the short walls are jointly formed with the deep walls in such a manner as will be described hereinbelow.

Figure 9:
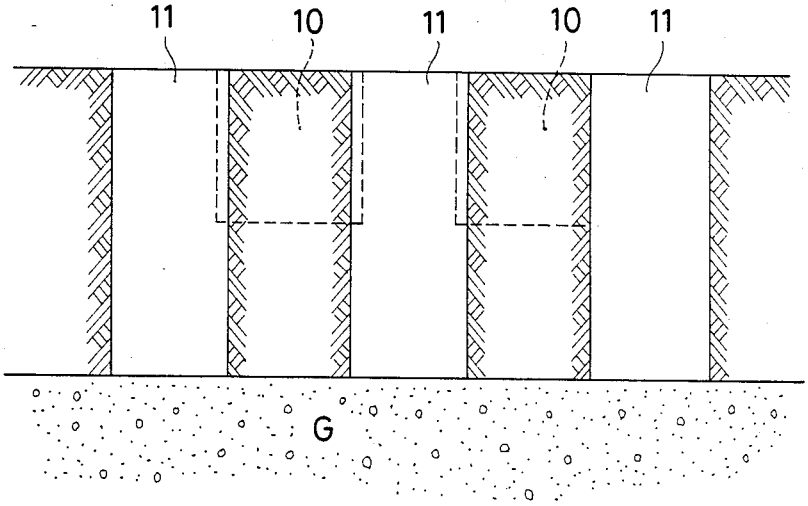

Namely, according to the present invention, the deep walls consisting of mixed layer of the soft soil and the cement-based hardening slurry and reaching the bearing stratum G are first formed at a distance therebetween. Then the short walls are respectively formed between these deep walls as shown in FIG. 9.

Also, as mentioned above, the deep walls are not required to reach the bearing stratum and the length thereof may appropriately be determined according to the hardness of the ground or the weight of a structure thereon.

In any way, according to the present invention, a plurality of deep walls 11 are at first formed and thereafter short walls 10 are formed between these deep walls 11.

In this manner, as the short walls 10 are respectively formed between the deep walls 11, the short walls may not be raised or lowered by the ground improvement machine as opposed to a conventional method.

Further, according to the present invention, while the cement-based hardening slurry is discharged at least upon the penetration of the ground improvement machine, the short walls are formed thus, even if the routes taken upon the penetration and extraction of the machine are not identical, an unimproved part will not remain thereby to facilitate a better cementing between the short and deep walls.

In this case, as mentioned above, discharge of the cement-based hardener may be interrupted upon the extraction of the ground improvement machine, or the cement-based hardener may be discharged both upon the penetration and extraction.

The effect of the present invention will now be described.

According to the present invention, a cement-based hardening slurry is discharged from the mixing propellers at least upon the penetration of the ground improvement machine having the mixing propellers. In this manner, the hardening slurry and soft soil may be mixed respectively upon the penetration and extraction of the machine, thereby evenly and properly mixing the hardening slurry with soft soil.

In a conventional method, the hardening slurry is discharged upon the extraction of the machine.

Accordingly, mixing is carried out only once and thus even and proper mixing as carried out in the present invention may not be achieved.

Further, according to the present invention, the rotating mixing propellers discharge the hardener slurry while shifting the location thereof. Accordingly, the hardening slurry is supplied to the soft soil in the form of concentric circles.

Hence, as compared to a conventional method wherein the location of the hardening slurry to be supplied is fixed, mixing effect of the hardening slurry may outstandingly be improved.

Still further, according to the present invention, as the hardening slurry is discharged from the rotating mixing propellers, the hardening slurry and soft soil may properly be mixed also by increasing the diameter of the mixing propellers and the number of the openings for discharging the hardening slurry.

Accordingly, a wide range of ground may be improved by one single operation and thus the period of hardening performance may be shortened.

Figure 1:
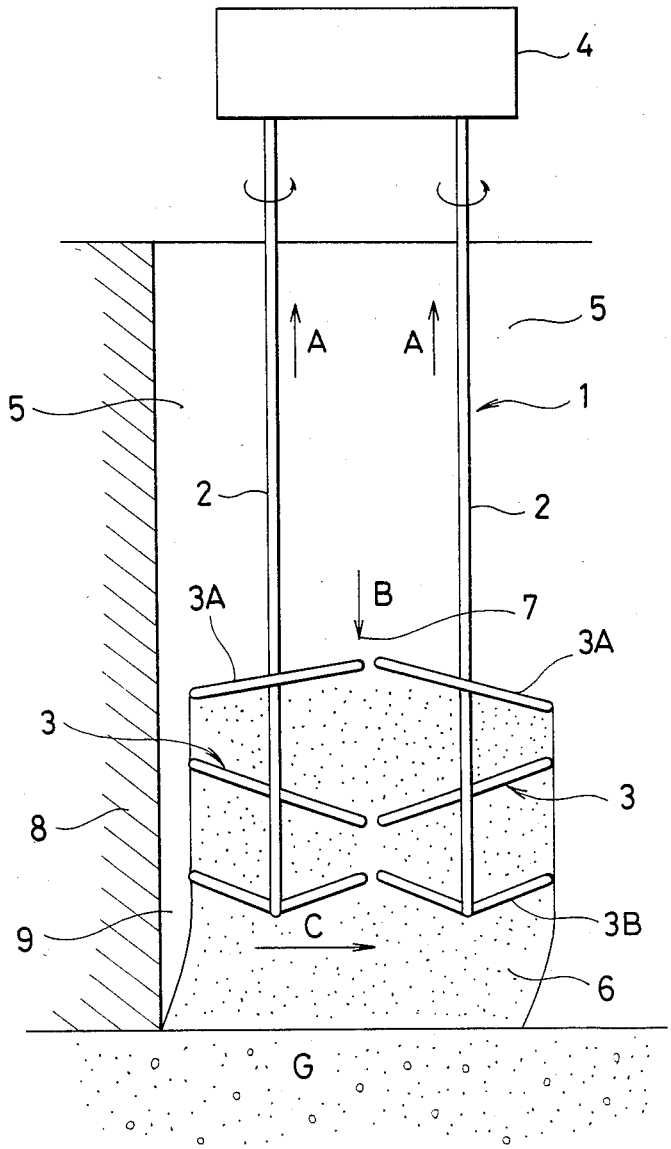
FIGS. 1 and 3 are schematic representations explaining a conventional method of hardening soft ground.
Figure 2:
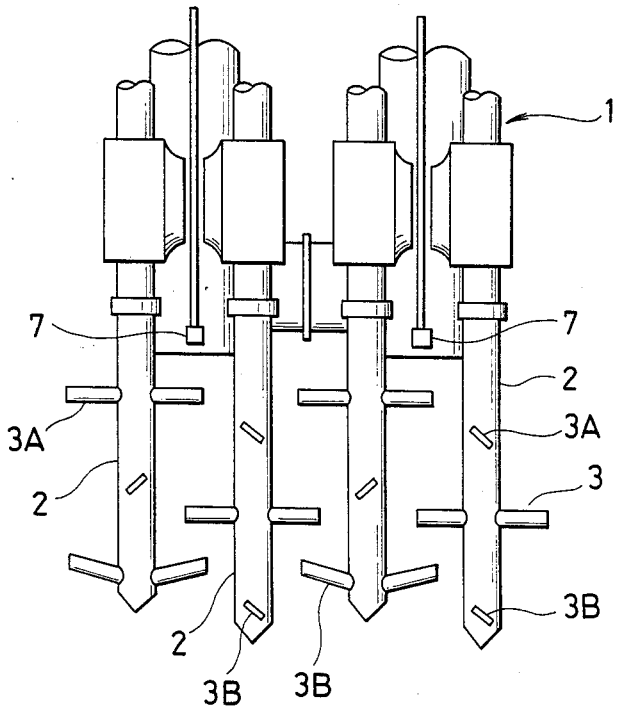
FIG. 2 is a side view of a ground improvement machine employed in a conventional method.
Figure 3:
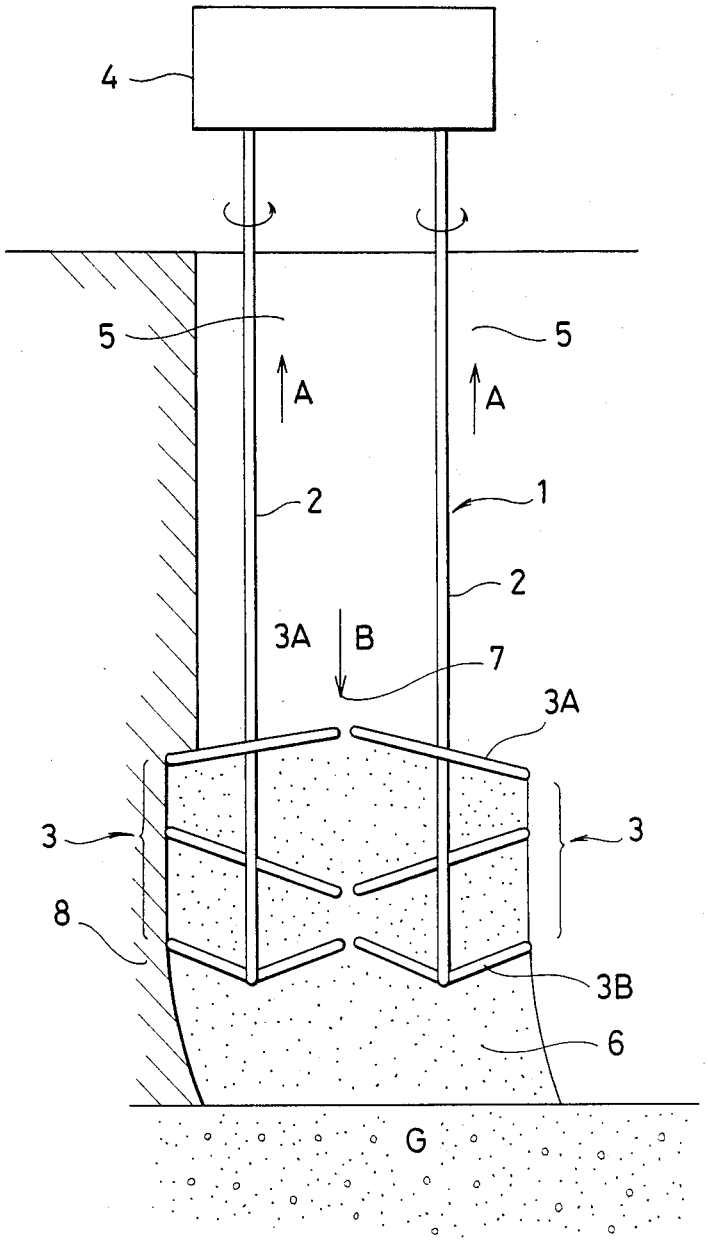
Figure 4:
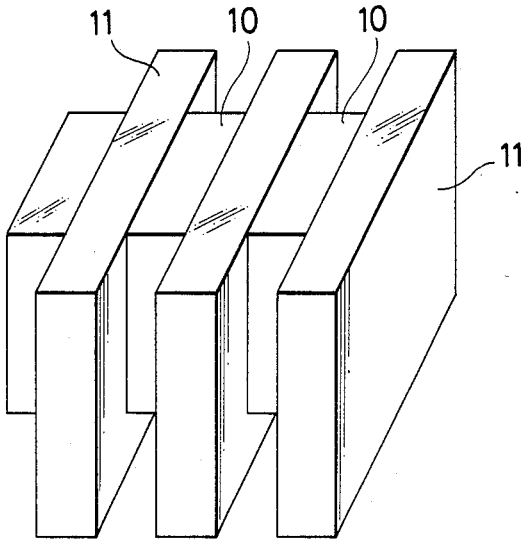
FIG. 4 is a perspective view explaining a method according to the present invention, wherein deep and short walls are formed one after the other.
Figure 5:
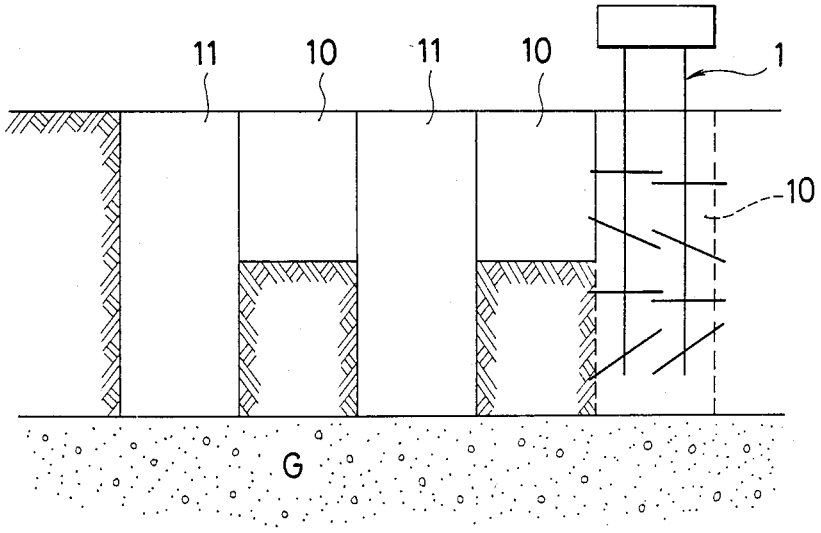
FIGS. 5, 6, and 9 are side views of FIG. 4.
Figure 6:
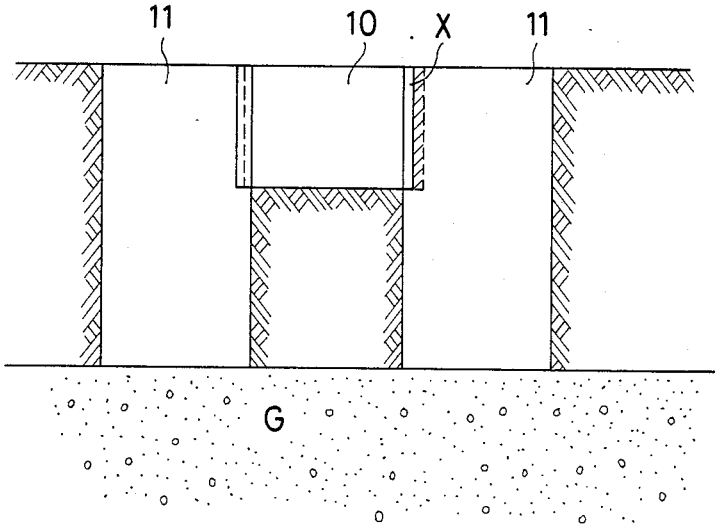

In a conventional method, the hardening slurry is not discharged from the mixing propellers, but from the outlet 7 (in FIG. 2) fixedly provided at a position located above the mixing propellers. For this reason, there is a limit to an increase in the diameter of the mixing propellers. Hence, the diameter of the mixing propellers may not be increased unlike the present invention and thus the period of hardening performance is difficult to be shortened.

Even further, according to the present invention, under normal performing conditions the capacity of each of stationary shafts and mixing shafts of the ground improvement machine is less than that of each of those machines used in a conventional method wherein the hardening slurry is discharged upon the extraction thereof. As a result, when the machine is penetrated into and extracted from the soft ground, the amount of soil to be eliminated is less in the present invention than the prior art.

Figure 10:
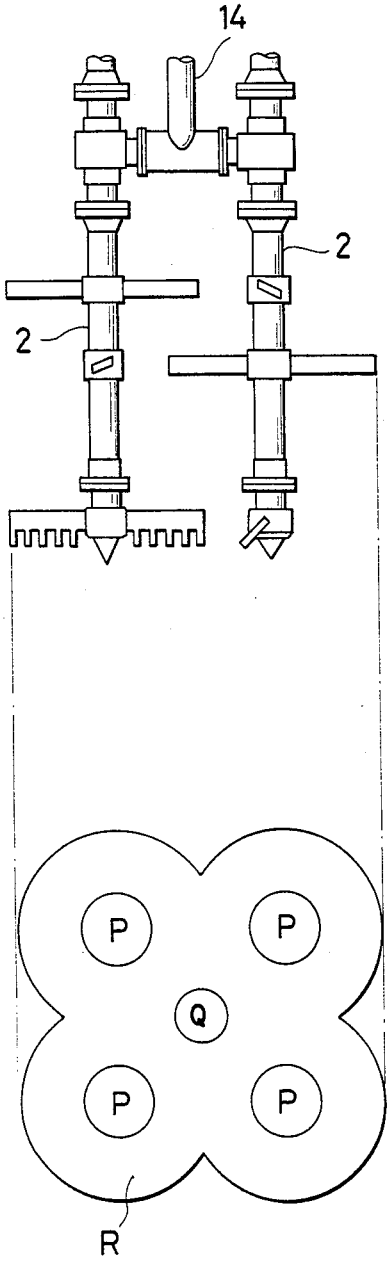
FIG. 10 shows the ground improvement machine to be employed in a method according to the present invention and the amount of soil to be cut thereby.
Figure 11:
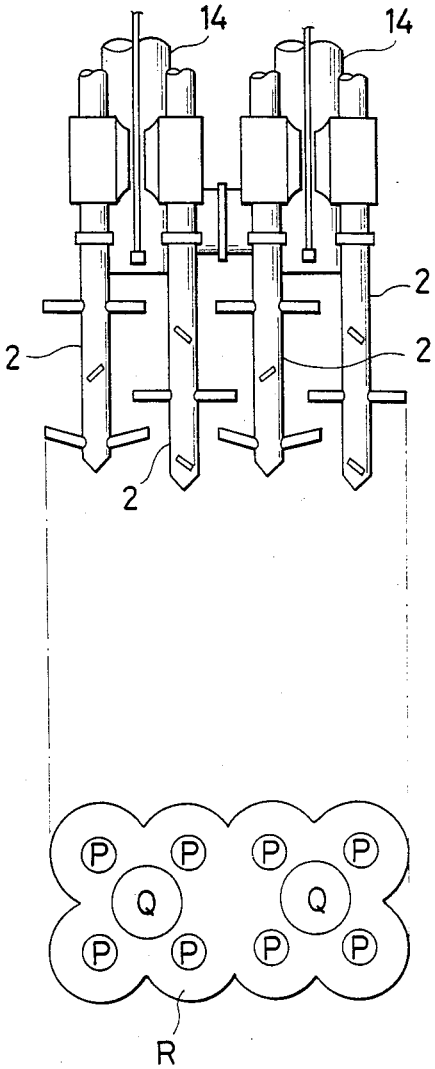
FIG. 11 shows the ground improvement machine employed in a conventional method and the amount of soil to be cut thereby.

Namely, as shown in FIGS. 10 and 11, in calculating the value of $$\frac{\text{Sectional area } P \text{ of mixing shaft 2} + \text{Sectional area } Q \text{ of stationary shaft 14}}{\text{mixing area } R}$$

respectively for the present invention (FIG. 10) and the prior art (FIG. 11), the present invention is 10 percent, whereas the prior art is 20 percent. The amount of soil to be eliminated is 50 percent less in the present invention than in the prior art.

In the above calculation, in FIG. 10 the sectional area P, Q and the mixing propeller are respectively 500 mm, 406 mm, and 1,800 mm in diameter, and in FIG. 11 the sectional area P, Q and the mixing propeller are respectively 267 mm, 700 mm and 1,000 mm in diameter.

Still further, according to the present invention, a plurality of the deep walls are firstly formed and the short walls are thereafter formed respectively between these deep walls. In this manner, the short walls are neither raised nor lowered when the deep walls are formed unlike as in a convention manner.

Still even further, according to the present invention, should the slow-hardening cement-based hardener be employed, the hardening process of existing improved ground may be delayed. Thus, cementing between the existing improved ground and the new improved ground may be improved.

Conventional cement-based hardener has no slow-hardening effect. Accordingly, when the hardening slurry is discharged upon the penetration of the machine, as the improved ground becomes deeper, surface layer may gradually be hardened. Therefore, the resistance to the penetration of the machine is increased and accordingly the function of improving the ground tends to be reduced.

However, in the present invention, with aid of the slow-hardening cement-based hardener, the machine can be prevented from lowering its operation efficiency even in the case of an operation at a great underground depth.

Hence, a method according to the present invention is suitable for a method of improving the soft ground of greater depth.

Additionally, in case that hardening performance takes place in the offing and such performance is interrupted by high wave or in case of a mechanical trouble, cementing between the existing improved ground and the new improved ground may not be affected in as much as the performance is again commenced within the time of hardening of the slow-hardening cement-based hardener.

There is an advantage such that anchorages may readily be embedded and anchored in the ground to be improved in accordance with the present invention.

We claim:

1. A method of hardening a soft ground, comprising the following steps (a) to (f), these steps being performed in sequential order:

(a) introducing a slurry of a cement-based hardener in water under pressure into a soft ground by a ground improvement machine and mixing the slurry with soft soil to form a deep pile, (b) repeating the above step (a) to form a plurality of deep piles in a manner such that every adjacent pile is joined together, whereby a deep wall is formed by the plurality of deep piles, (c) repeating the above steps (a) and (b) to form a plurality of deep walls spaced from one another, (d) introducing the slurry under pressure into soft ground between two adjacent deep walls and mixing the slurry with soft soil to form a short pile joined to said two adjacent deep walls, (e) repeating the above step (d) to form a plurality of short piles joined to one another and to said two adjacent deep walls, so that a short wall, joined to said two adjacent deep walls, is formed by the plurality of short piles, and (f) repeating the above steps (d) and (e) to form a plurality of short walls each joined to two adjacent deep walls.

2. A method of hardening soft ground according to claim 1, wherein low-hardening cement-based hardener is employed as the cement-based hardener.

3. A method as claimed in claim 1, wherein said slurry is discharged from mixing propellers of said ground improvement machine when penetrating the machine into the soft ground.

4. A method of hardening soft ground according to claim 3, wherein mixing is only carried out upon the extraction of said ground improvement machine.

5. A method of hardening soft ground according to claim 3, wherein a plurality of said mixing propellers are provided one above the other and said cement-based hardening slurry is discharged from the lowermost mixing propellers.

6. A method of hardening soft ground according to claim 3, wherein a plurality of said mixing propellers are provided one above the other and said cement-based hardening slurry is discharged from the uppermost mixing propellers upon the extraction of said ground improvement machine.

* * * * *